United States Patent [19]

Schuemann

[11] Patent Number: 4,942,801

[45] Date of Patent: Jul. 24, 1990

[54] FIREARM GUN RISE AND MUZZLE JUMP REDUCER

[76] Inventor: Wil Schuemann, 705 Wagner Dr., Carson City, Nev.

[21] Appl. No.: 321,898

[22] Filed: Mar. 10, 1989

[51] Int. Cl.[5] ..... F41F 17/12

[52] U.S. Cl. ..... 89/14.3

[58] Field of Search ..... 89/14.3, 163, 186

[56] References Cited

U.S. PATENT DOCUMENTS

| | | | |
|---|---|---|---|
| D. 285,235 | 8/1986 | Cellini | D22/108 |
| 513,398 | 1/1894 | Kingsland et al. | 89/14.3 |
| 1,190,107 | 7/1916 | Carroll | 89/14.3 |
| 1,315,504 | 4/1918 | Hamm | 89/14.3 |
| 1,380,358 | 7/1921 | Cooke | 89/14.3 |
| 1,390,658 | 9/1921 | Towson | 89/14.3 |
| 1,450,558 | 4/1923 | Maze | 89/14.3 |
| 1,549,847 | 8/1925 | Reed | 89/14.3 |
| 1,554,051 | 5/1924 | Walker | 89/14.3 |
| 1,628,896 | 5/1927 | Medearis | 89/14.3 |
| 2,143,596 | 1/1939 | Galliot et al. | 89/14.3 |
| 2,191,648 | 2/1940 | Galliot et al. | 89/14.3 |
| 2,223,014 | 11/1940 | Galliot et al. | 89/14.3 |
| 2,420,492 | 5/1947 | Marseilles | 89/14.3 |
| 2,935,000 | 5/1960 | Mowrey | 89/14.3 |
| 3,227,045 | 1/1966 | Kruzell | 89/14.3 |
| 3,665,804 | 5/1972 | Rohr | 89/14.3 |
| 3,707,899 | 1/1973 | Perrine | 89/14.3 |
| 3,808,943 | 5/1974 | Kelly | 89/14.3 |
| 3,858,481 | 1/1975 | Elliott | 89/14.3 |
| 4,008,538 | 2/1977 | Center | 89/14.3 |
| 4,207,799 | 6/1980 | Tocco | 89/14.3 |
| 4,322,999 | 4/1982 | Aston | 89/14.3 |
| 4,392,413 | 7/1983 | Gwinn, Jr. | 89/14.3 |
| 4,406,078 | 9/1983 | DeBlieck | 89/14.3 |
| 4,534,264 | 8/1985 | Tarnoff et al. | 89/14.3 |
| 4,545,285 | 10/1985 | McClain | 89/14.3 |
| 4,635,528 | 1/1987 | McQueen | 89/14.3 |
| 4,643,073 | 2/1987 | Johnson | 89/14.3 |
| 4,691,614 | 9/1987 | Leffel et al. | 89/14.3 |

FOREIGN PATENT DOCUMENTS

| | | | |
|---|---|---|---|
| 562475 | 10/1932 | Fed. Rep. of Germany | 89/14.3 |
| 800052 | 6/1936 | France | 89/14.3 |
| 931300 | 2/1948 | France | 89/14.3 |
| 1055954 | 11/1983 | U.S.S.R. | 89/14.3 |
| 2466 | of 1865 | United Kingdom | 89/14.3 |

*Primary Examiner*—Charles T. Jordan
*Assistant Examiner*—Stephen Johnson
*Attorney, Agent, or Firm*—Cahill, Sutton & Thomas

[57] ABSTRACT

A group of upwardly directed ports disposed in a barrel of a hand held firearm intermediate the chamber and the muzzle of the firearm vent propellant gasses upwardly upon discharge of the firearm to produce a downwardly directed component of thrust to counteract gun rise and muzzle jump. Preferably, the center of the group of ports is in the vicinity of midway between the chamber and the muzzle. The ports may be straight or tapered passages or they may be nozzles.

37 Claims, 3 Drawing Sheets

FIREARM GUN RISE AND MUZZLE JUMP REDUCER

BACKGROUND OF THE INVENTION

1. Field of the Invention:

The present invention relates to porting of the propellant gas of a firearm and, more particularly, to the reduction of gun rise and muzzle jump of a firearm through upward porting of the propellant gas.

2. Description of the Prior Art:

Handheld firearms, when fired, exhibit a phenomenon usually described as muzzle jump. The common intuitive understanding of the phenomenon has provided guidance for gunsmiths and inventors who have generated numerous devices intended to reduce the magnitude of the normal upward motion of the muzzle by venting the propellant gas upwardly at the muzzle to create a downward thrust on the muzzle. The ultimate purpose of these devices was and is that of permitting firing a series of shots more rapidly and accurately.

A more complete understanding of the phenomena which interfere with the rapid shooting of the firearm is required to more accurately address a solution. Central to this increased understanding is the concept that the phenomenon of gun rise is separate from the phenomenon of muzzle jump. Gun rise is an upward motion of the entire firearm when it is fired which would occur even if muzzle jump were completely eliminated. This concept of gun rise is not addressed in the known prior art. Gun rise is a small upward motion of the firearm which interferes with the aiming of the firearm when several shots are fired from the firearm in quick succession. Gun rise motion occurs after the well known muzzle rise motion. Virtual elimination of gun rise permits the shooter to fire a series of shots rapidly and more accurately than is otherwise possible.

The known prior art is directed to reduction or elimination of muzzle jump. Generally the muzzle jump is sought to be countered by the installation of ports directly into the barrel near the muzzle to vent the propellant gas directly into the atmosphere. Numerous variants of such vents exist. Radial (upward, lateral and/or downward) porting of propellant gas from the barrel near the muzzle through simple ports allegedly improves accuracy or allegedly reduces recoil by reducing the propellant gas pressure in the barrel before the projectile leaves the muzzle. Upward porting of the barrel near the muzzle with side by side paired ports with each port of each pair being equally spaced from a vertical plane coincident with the axis of the barrel is a well known variant which allegedly helps reduce muzzle jump. In some embodiments, the propellant gas may be vented radially (laterally), without upward venting at the muzzle. Another approach includes using radial (lateral) ports disposed in the barrel between the chamber and muzzle to vent the propellant gas posteriorly into the atmosphere to help reduce recoil. Finally, it is known to use radially oriented, backward facing and diverging ports spaced from near the chamber to near the muzzle to vent the propellant gas simultaneously in different directions.

SUMMARY OF THE INVENTION

A group of simple ports or diverging nozzles vent the propellant gas upwardly from within the barrel. The group of ports is placed in the upper surface of the barrel or in a rib on the top of the barrel with the axis of each port or nozzle being generally in a vertical plane coincident with the axis of the barrel. The fore and aft center of the group of ports is located somewhat forwardly of a point midway between the chamber and muzzle of the firearm. Such placement of the group of ports produces a substantial downward thrust on the firearm. The thrust produced is located close to the center of mass of the firearm with the principal effect being that of urging the firearm downwardly to virtually eliminate the motion of gun rise. Secondarily, because the location of the thrust is somewhat forward of the center of mass of the firearm, the muzzle jump of the firearm is also reduced.

It is therefore a primary object of the present invention to provide ports for a handheld firearm which substantially reduce the gun rise motion of the firearm when it is fired.

Another object of the present invention to improve upon the reduction of muzzle jump as a secondary benefit of countering gun rise.

Yet another object of the present invention is to avoid maintenance problems caused by the accumulation of propellant combustion residue and lead within venting ports.

Still another object of the present invention is to reduce the normal disturbance of the projectile's direction caused by high pressure propellant gas rushing around the projectile as the projectile exits the muzzle.

A further object of the present invention is to provide a group of ports in the barrel of a firearm that essentially completely empty the barrel of propellant gas before the projectile exits the muzzle.

A yet further object of the present invention is to provide a group of ports in the barrel of a firearm that eliminate the normal increase in the recoil of the firearm caused by propellant gas venting from the muzzle.

A still further object of the present invention is to provide a downward thrust through upward directed nozzles venting the barrel of a firearm and centered close to the center of mass of the firearm to reduce gun rise and muzzle jump.

A still further object of the present invention is to provide a method for venting a handheld firearm to reduce gun rise and muzzle jump.

These and other objects of the present invention will become apparent to those skilled in the art as the description of the present invention proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Figure 1:
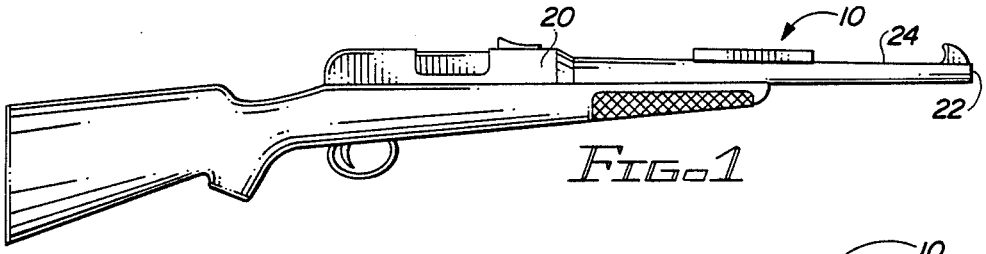
FIG. 1 illustrates a rifle or a shotgun incorporating the present invention.

This invention applies equally well to all types of firearms and particularly handheld firearms, such as rifles, shotguns, sub-machine guns, handguns, semi automatic pistols, etc. The principals inherent in this invention will be described using primarily a rifle and a handgun as examples.

A more complete understanding of the phenomenon heretofore called muzzle jump renders it evident that the motion of a firearm when fired consists of a sequence of two motions. The first motion is a very rapid upward rotation of the gun pivoting about a point located somewhere between the center of gun/hand mass and the wrist. This is the motion which is clearly apparent to the eye when the handgun is fired and is widely referred to as muzzle jump. The second motion occurs after the first motion and consists of a relatively smaller, slower, less obvious upward motion of the gun, as the gun, hand and arm rotate upwardly about a pivot point at the shoulder. During this second motion the upper portion of the firearm blocks the shooter's view of the target and the aiming process cannot resume until the motion ends and the gun is returned to the prefiring position. This motion may be accurately referred to as gun rise.

The ability of the shooter to fire the gun rapidly and accurately is limited by both the muzzle jump and the gun rise motions because they interrupt the ability of the shooter to aim the firearm. All known prior art solutions have focused upon reducing the visually apparent muzzle jump. The second motion, that of the gun, hand and arm relatively slowly rotating upwardly about the shoulder and then returning to the prefiring position, has not been noted explicitly in the prior art and the popular press. The end of the gun rise motion, rather than the end of the muzzle jump motion, determines when the shooter can aim and fire the gun again because gun rise occurs after muzzle jump. It is the purpose of this invention to substantially reduce both motions but with more emphasis on reducing gun rise. This improves the ability of the shooter to shoot the firearm rapidly and accurately. Even if it were possible to completely eliminate muzzle jump, as attempted by the prior art, gun rise would still occur.

The amount of downward thrust which can be generated by porting the propellant gas at the muzzle is small because the energy of the propellant gas has been substantially spent by the time the projectile or bullet reaches the muzzle. In addition, the modification to the forward end of the barrel or the installation of a device at the muzzle must accomplish its function in the time period between the base of the bullet passing into the area of the modification or device and exiting the muzzle to no longer obstruct passage of the propellant gas out the front of the barrel or device. The time available for the modification or device to function is therefore very short and this short time period restricts the possible effectiveness of the modification or device.

The present invention consists of a group of simple ports or diverging nozzles installed in a line along the upper surface of the barrel and between the chamber and muzzle. Usually the first port of the group will be closer to the chamber than to the muzzle and the remainder of the group of ports will be spaced along the upper surface of the barrel between the first port of the group and the muzzle. This line of ports produces a downward thrust on the firearm by upward venting of the propellant gas from the barrel.

Several advantages over the prior art muzzle oriented ports are achieved from such a group of ports: (1) there is more time available to vent the propellant gas from the barrel before the bullet leaves the muzzle because the venting begins sooner; (2) the earlier venting permits the venting of virtually all the propellant gas in the barrel upwardly through the group of simple ports or diverging nozzles to maximize the generation of downward thrust; (3) because more time is available, more efficient conversion of the gas energy into downward thrust is possible; (4) the gas will be at a higher pressure nearer the chamber when the venting begins and more energy is therefore stored in the gas to be converted into downward thrust closest to the chamber; (5) because the pressure in the barrel is reduced for a substantial distance along the barrel, it is necessary to increase the propellant charge in order to maintain the original bullet or projectile velocity, thereby more gas at a higher pressure can be utilized to produce a substantial increase in the downward thrust available for reducing gun rise and muzzle jump. By using nozzles rather than ports, several advantages are obtained: (1) the nozzles are more efficient in converting gas energy into downward thrust; and (2) the duration of the discharging gases permits an improved thrust coefficient of the nozzles.

Figure 2:
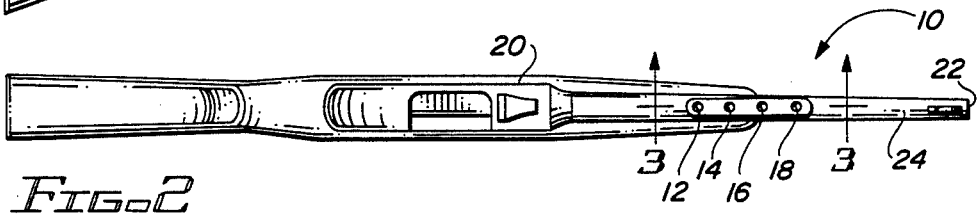
FIG. 2 is a top view of the rifle or shotgun.
Figure 3:
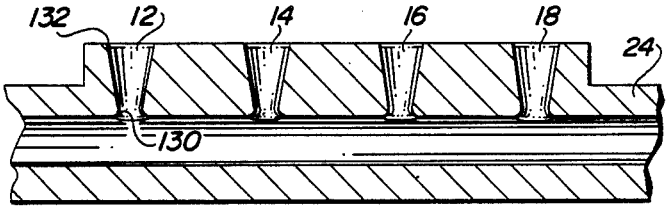
FIG. 3 is a partial cross sectional view taken along lines 3—3, as shown in FIG. 2.

The present invention can be incorporated into all firearms and particularly handheld firearms, as will be evident from the following overview of the invention with reference to the figures. FIGS. 1–3 illustrate a rifle 10 (or shotgun) incorporating a group of ports or nozzles (12,14,16 and 18). First port 12 of the group of ports is usually closer to chamber 20 than to muzzle 22 of the firearm and the remainder of the group of ports (14,16,18) is spaced along the top of barrel 24 between the first port and the muzzle.

Figure 4:
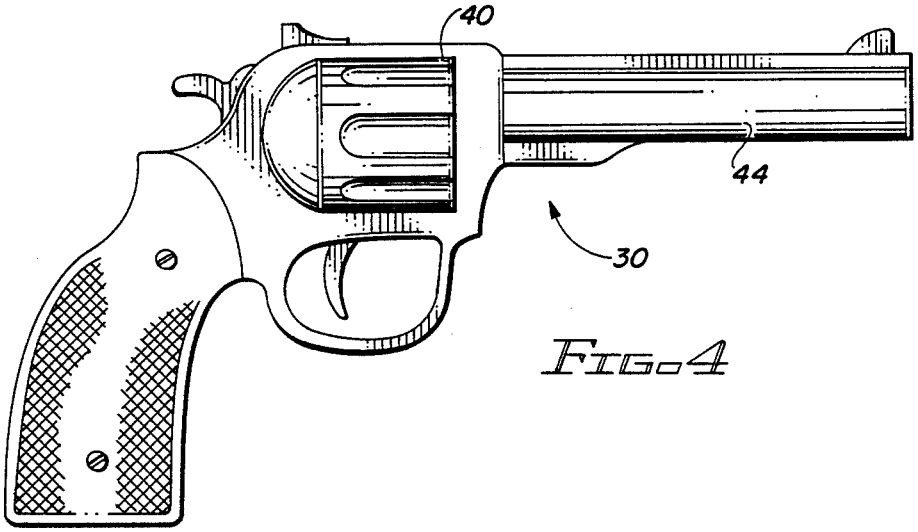
FIG. 4 illustrates a revolver incorporating the present invention.
Figure 5:
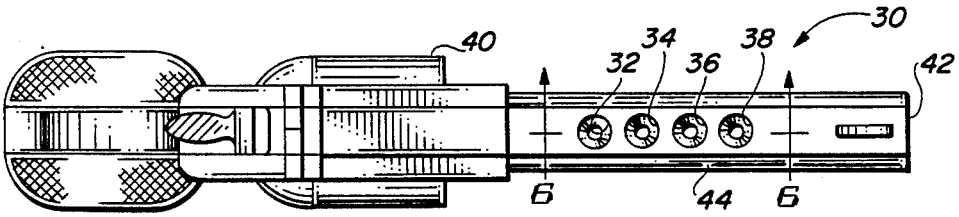
FIG. 5 is a top view of the revolver.
Figure 6:
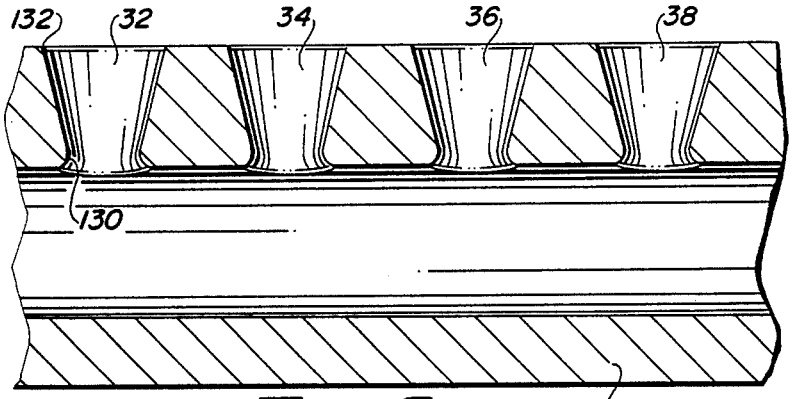
FIG. 6 is a partial cross sectional view taken along lines 6—6, as shown in FIG. 5.
Figure 7:
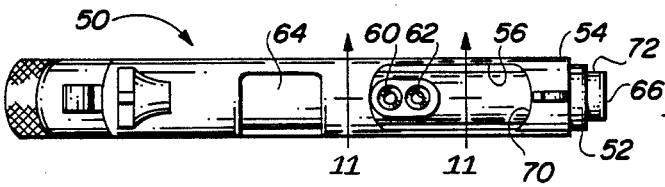
FIG. 7 is a top view of a semi automatic pistol incorporating the present invention.
Figure 8:
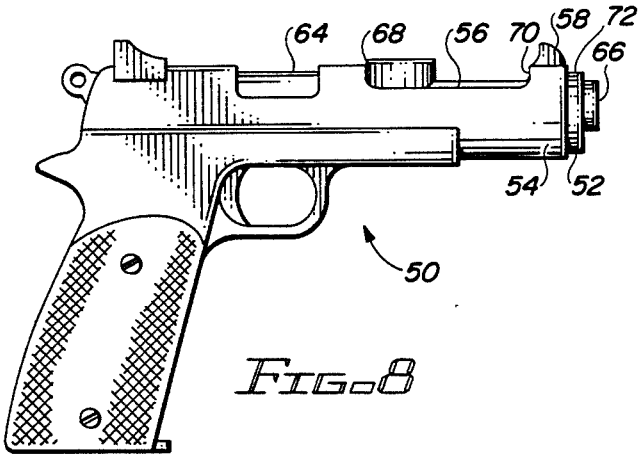
FIG. 8 is a side view of the pistol shown in FIG. 7.
Figure 9:
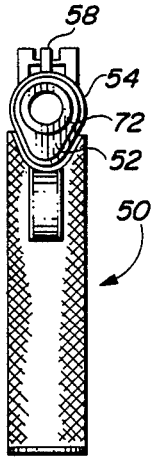
FIG. 9 is a front view of the pistol shown in FIG. 7.

FIGS. 4–6 illustrate a revolver 30 incorporating the present invention. First port 32 of the group of ports or nozzles (32,34,36 and 38) is usually closer to chamber 40 than to muzzle 42 of the firearm and the remainder of the group of ports (34,36 and 38) are spaced along the top of barrel 44 between the first port of the group of ports and the muzzle.

Figure 10:
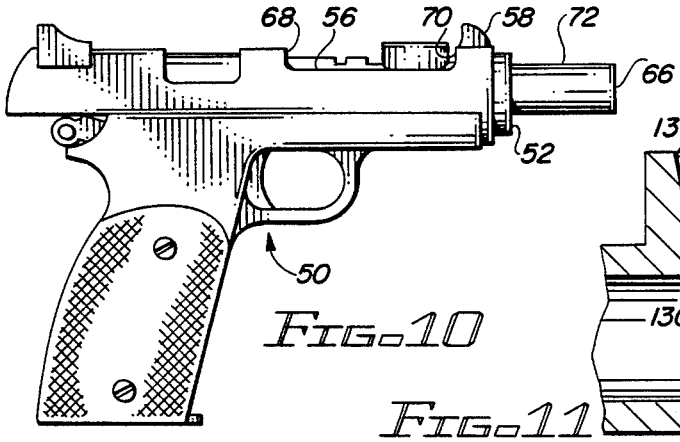
FIG. 10 is a side view of the pistol shown in FIG. 7 in the recoiled position.

FIGS. 7–11 illustrate a semi-automatic pistol 50 incorporating the present invention and employing a continuous forward barrel bushing 52. The figures illustrate slide 54 in battery (FIGS. 7 and 8) and in the full recoil position (FIG. 10). Opening 56 in the top of the slide extends from forward of the locking lugs (not shown) to forward sight 58. First port 60 of the group of ports or nozzles (60,62) is closer to chamber 64 than to muzzle 66 of the firearm. In this case, port 60 is likely adjacent to the locking lugs and the remainder of the group of ports will be on the muzzle side of and close to the first port of the group of ports to permit slide 54 to move without interference during normal functioning of the gun. When the slide is in battery (FIGS. 7 and 8), ports 60,62 are located at the aft end of opening 56 in slide 54. When the slide is in the full recoil position (FIG. 10) the ports (60,62) are located at the forward end (70) of opening 56 in the slide. It should be noted that forward barrel bushing 52 completely surrounds barrel 72.

Figure 12:
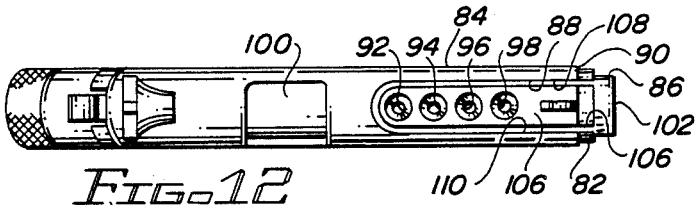
FIG. 12 is a top view of a semi automatic pistol incorporating the present invention.
Figure 13:
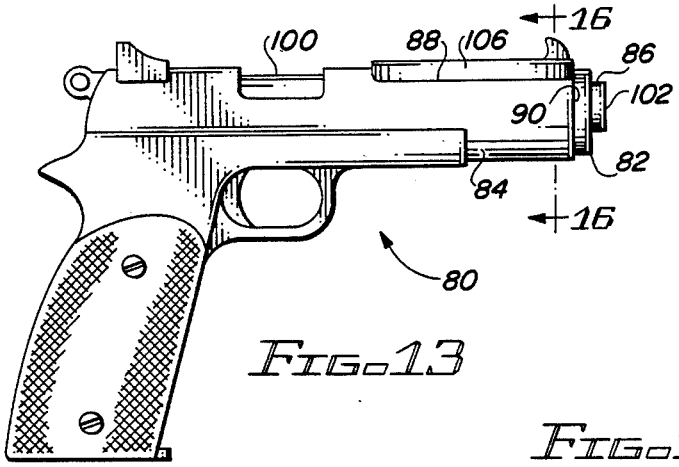
FIG. 13 is a side view of the pistol shown in FIG. 12.
Figure 14:
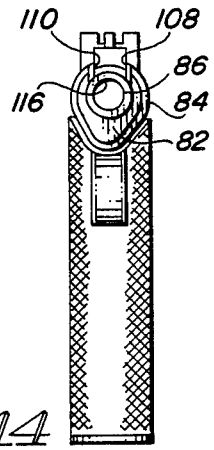
FIG. 14 is a front view of the pistol shown in FIG. 12.
Figure 15:
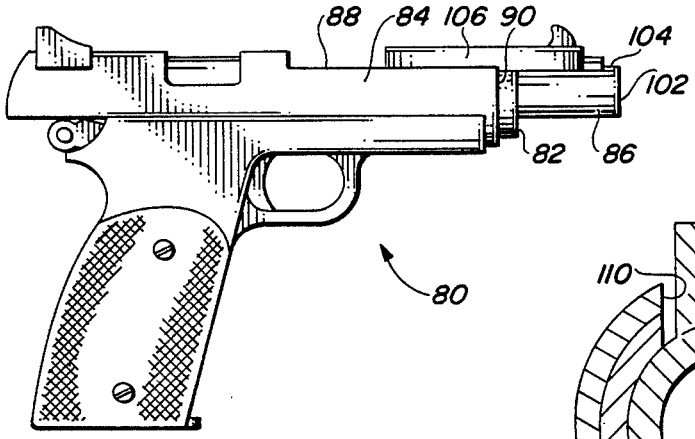
FIG. 15 is a side view of the pistol shown in FIG. 12 in its recoiled position.
Figure 16:
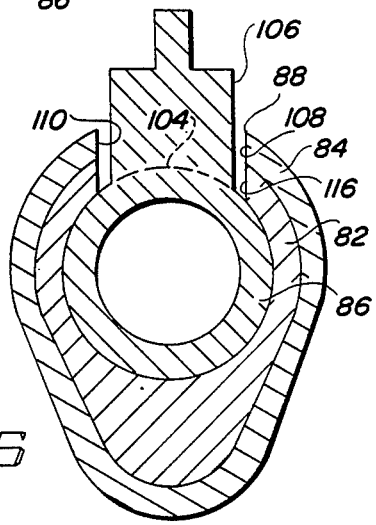
FIG. 16 is a cross sectional view taken along lines 16—16, as shown in FIG. 13.

FIGS. 12–16 illustrate a semi-automatic pistol 80 incorporating the present invention and employing a slotted forward barrel bushing 82. FIG. 12 illustrates slide 84 in battery; FIG. 15 illustrates the slide in the full recoil position; and, FIG. 16 illustrates a cross section transverse to the axis of barrel 86 through the barrel bushing. Opening 88 in the top of slide 84 extends from forward of the locking lugs (not shown) to forward end 90 of the slide. First port 92 of the group of ports or nozzles (92,94,96 and 98) is usually closer to chamber 100 than to muzzle 102 of the firearm and the remaining ports (94,96 and 98) are spaced along top 104 of barrel 86 between the first port of the group of ports and the muzzle. The group of ports is installed in the barrel and extended through an upper portion of the barrel called a rib 106; the rib extends from close to the locking lugs (not shown) forward to the muzzle end of slide 84. When the slide is in battery (FIGS. 12 and 13), the rib containing the ports 92,94,96 and 98 fills opening 88 in slide 84 and extends a short distance above the slide. When the slide is in the full recoil position (FIG. 15) the opening has moved aft thereby making the upper surface of barrel 86 visible through the opening in the slide. It should be noted that the forward barrel bushing surrounds the barrel except where the forward barrel bushing is slotted to provide clearance for rib 106 to permit the barrel bushing to move along the barrel during normal cycling of the firearm. FIG. 16 illustrates a section transverse to the axis of the barrel and the slotted nature of the forward barrel bushing.

Of the many types of handheld firearms that could incorporate the present invention, semi automatic handgun 80 of the type illustrated in FIGS. 12–16 is well known and will be described in detail. This type of handgun is a 0.45 caliber semi automatic known as a United States government model 1911-A1. Only three pieces of the 1911-A1 handgun need to be modified; the slide (84), the barrel (86) and the forward barrel bushing (82). As shown in FIGS. 12–16, the slide of the 1911-A1 handgun has been modified by cutting an opening 88 or slot into the upper forward surface of the slide. The slot would typically be 2.800 inches long and 0.400 inches wide with essentially vertical inner surfaces 108,110. Rear sight 112 would have to be raised about 0.250 inches to accommodate the positioning of front sight 114 upon rib 106, which sight may be 0.170 inches high. Barrel 86 has been modified by the installation of rib 106 which is typically 2.770 inches long by 0.375 inches wide by 0.350 inches high. While not visible in the figures, a small lateral slot is formed at the base of the rib near the forward end of the rib for the purpose of permitting certain manipulations of the forward barrel bushing during assembly of the 1911-A1 handgun. Typically, there will be six ports (instead of the four ports (92,94,96,98) shown in the figures) machined into the barrel/rib assembly. The axis of the first port is 0.190 inches from the aft end of rib 106 and the remaining five nozzles are spaced on 0.340 inch centers forwardly toward muzzle 102. The most forward port axis is 0.880 inches from the forward end of rib 106. The forward end of the rib is 0.130 inches from the muzzle so the most forward port is 1.010 inches from the muzzle.

Figure 11:
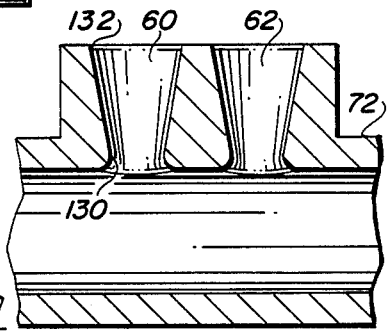
FIG. 11 is a partial cross sectional view taken along lines 11—11, as shown in FIG. 7.

Preferably the ports are nozzles of the type illustrated in FIGS. 3, 6 and 11. For a 0.452 caliber 1911-A1 handgun, each nozzle throat 130 is 0.187 inches inside diameter and the diameter of nozzle exit 132 is 0.310 inches. The nozzle expansion ratio is thus 2.75, giving a thrust coefficient of approximately 1.5 at the typical operating conditions for the 1911-A1 handgun. Forward barrel bushing 82 is modified by cutting a vertical slot 116 0.400 inches wide and aligned with slot or opening 88 in slide 84 when the forward barrel bushing is installed in the slide.

To test the effectiveness of the barrel mounted nozzles, a gun supporting fixture was built. The fixture included a pivotally mounted "hand" element for supporting the gun and representative of a user's hand. Springs were employed to simulate the normal resilience of the wrist muscles in discouraging rotation of the hand. A further spring loaded pivotally mounted "arm" element supported the "hand" element to simulate the natural arm movement. Marking devices for recording vertical and pivotal movement of the "hand" element upon firing of the gun were incorporated. The tests were conducted with the 1911-A1 handgun (0.45 caliber) without a compensator, with several commercially available representative muzzle mounted "muzzle jump" compensators and with upwardly directed nozzles formed in the barrel in accordance with the present invention. In all tests the same gun type and 200 grain projectiles with equally loaded cartridges were used. The data obtained by the markings produced at each firing was reduced mathematically to provide information on the amount of rise of the gun and the amount of rotation of the gun. For simplicity of comparison purposes, the data was normalized to the rise and rotation of an unmodified 1911-A1 handgun. This data appears in the following table:

TABLE

| Type of Compensation | Distance of Rise (%) | Degree of Rotation (%) | Energy of Rise (%) | Energy of Rotation (%) |
|---|---|---|---|---|
| UNCOMPENSATED | 100 | 100 | 100 | 100 |
| MORE OR LESS CONVENTIONAL MUZZLE MOUNTED MUZZLE JUMP COMPENSATORS | | | | |
| TYPE A | 73 | 82 | 53 | 66 |
| TYPE B | 79 | 76 | 63 | 58 |
| TYPE C | 78 | 83 | 61 | 68 |
| PRESENT INVENTION WITH SIX NOZZLES | 43 | 69 | 18 | 47 |

Reviewing these comparative figures, one can readily conclude that a conventional muzzle jump compensator produces a 23% decrease in the visually perceived gun rise and a 41% decrease in gun rise energy. The embodiment of the present invention produces a 57% decrease in the visually perceived gun rise and an 82% decrease in gun rise energy.

These figures clearly evidence an advance in the state of the art to reduce the problems associated with shooting a handheld firearm quickly and accurately. Shooting performance, measured to test for both speed and accuracy and using firearms incorporating the present invention, has shown very substantial speed and accuracy improvements over the performance possible using firearms incorporating any of the prior art ports and devices. These figures may even underestimate the ultimate shooting performance improvement possible using handheld firearms incorporating the present invention.

As stated earlier, the greatest impediment to rapid and accurate firing was discovered to be gun rise, not muzzle jump. Based upon the test results obtained, it will be self evident that the present invention provides a significant and effective reduction to gun rise over that of conventional muzzle mounted muzzle jump compensators.

Through further experiments it has been determined that the degree of gun rise compensation can be modified to avoid either over or under compensation by restricting or enlarging the diameter(s) of the nozzles close to the chamber. Moreover, the number of nozzles and their relative location anteriorly of the chamber can be optimized to suit particular caliber hand held guns and the amount and burn rate of the charge in the cartridges. Preferably, the center of thrust of the group of ports is believed to render best results if it is just forward of the center of gravity, as noted earlier. As a result of these experiments it has been determined that the use of four nozzles, as illustrated, provides an excellent compromise of cost, structural integrity, compensation for gun rise and compensation for muzzle jump. Moreover, an inlet nozzle diameter of 0.187 inches, an outlet nozzle diameter of 0.310 inches providing an expansion ratio of 2.75 and a thrust coefficient of approximately 1.5 has yielded excellent results; upon experimentation and further understanding of nozzles, different dimensions and parameters may be developed. As illustrated in the drawings, the nozzle inlet should be chamfered to aid in streamlining the gas flow into the nozzle and to reduce lead fouling.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for reducing a gun rise and muzzle jump of a semi automatic pistol having a chamber, a barrel having a bore formed therein and extending from the chamber and a muzzle defining an outlet end of the bore, a slide translatable along the barrel from a battery position to a recoil position and return during each discharge cycle of the pistol, said apparatus comprising in combination:

(a) at least one upwardly directed nozzle disposed in the barrel for exhausting propellant gas therethrough from the bore of the barrel upon discharge of the pistol to develope a downwardly directed thrust force on the pistol to counter the gun rise and the muzzle jump of the pistol upon discharge, said nozzle being disposed in the barrel at a location closer to the chamber than to the muzzle;

(b) a plurality of further nozzles disposed in the barrel for exhausting propellant gas therethrough from the bore of the barrel upon discharge of the pistol to develope a downwardly directed thrust force on the pistol to counter the gun rise and muzzle jump of the pistol upon discharge, said plurality of nozzles being disposed in the barrel at locations toward the muzzle from said at least one nozzle;

(c) an opening disposed in said slide for maintaining said at least one nozzle and said plurality of further nozzles exposed during translation of said slide from the battery position to the recoil position and return; and (d) a barrel bushing disposed intermediate said slide and the barrel for supporting said slide upon the barrel, said barrel bushing being configured to maintain said at least one nozzle and said plurality of further nozzles exposed during translation of said slide.

2. The apparatus as set forth in claim 1 wherein the bore of the barrel includes a longitudinal axis of rotation and wherein the thrust generated by each of said at least one nozzle and said plurality of further nozzles is normal to the longitudinal axis of rotation of the bore of the barrel.

3. The apparatus as set forth in claim 1 wherein each nozzle defines a coefficient of thrust and wherein the coefficient of thrust of each nozzle of said at least one nozzle and said plurality of further nozzles is on the order of 1.5.

4. The apparatus as set forth in claim 1 wherein said plurality of further nozzles comprises at least three nozzles.

5. The apparatus as set forth in claim 4 wherein said at least one nozzle and said plurality of further nozzles are in line.

6. The apparatus as set forth in claim 1 wherein the bore includes an axis of rotation and wherein said at least one nozzle and said plurality of further nozzles generate thrust and wherein the thrust generated is in a common plane passing through the axis of rotation of the bore.

7. The apparatus as set forth in claim 1 wherein the pistol includes a center of mass and wherein the thrust of said at least one nozzle and said plurality of further nozzles acts through a center of thrust and wherein the center of thrust is anterior of the center of mass of the pistol.

8. The apparatus as set forth in claim 1 wherein the barrel includes a front sight and wherein said slide includes a slit for receiving the front sight.

9. The apparatus as set forth in claim 8 wherein said barrel bushing includes a further slit and wherein said further slit is coincident with said slit of said slide.

10. The apparatus as set forth in claim 9 wherein said slit of said slide includes opposed sidewalls and wherein the further slit of said barrel bushing includes further opposed sidewalls in alignment with said opposed sidewalls of said slide slit.

11. The apparatus as set forth in claim 11 wherein said barrel bushing extends proximate the muzzle in the battery position of the firearm and wherein said barrel bushing extends part way about the barrel.

12. The apparatus as set forth in claim 11 wherein said at least one nozzle and said plurality of further nozzles are in line.

13. The apparatus as set forth in claim 11 wherein each of said nozzles includes an inlet and an outlet and wherein said inlet is chamfered.

14. Apparatus for reducing a gun rise and a muzzle jump of a semi automatic pistol having a chamber, a barrel having a bore formed therein and extending from the chamber and a muzzle defining an outlet end of the bore, a slide translatable along the barrel from a battery position to a recoil position and return during each discharge cycle of the pistol, said apparatus comprising in combination:

(a) a rib extending upwardly from the barrel;

(b) at least one upwardly directed nozzle extending through the rib and the barrel for exhausting propellant gas therethrough from the bore of the barrel upon discharge of the pistol to develope a downwardly directed thrust force on the pistol to counter the gun rise and the muzzle jump of the pistol upon discharge, said nozzle being disposed at a location along the barrel closer to the chamber than to the muzzle;

(c) a plurality of further nozzles extending through the rib and the barrel for exhausting propellant gas therethrough from the bore of the barrel upon discharge of the pistol to develope a downwardly directed thrust force on the pistol to counter the gun rise and muzzle jump of the pistol upon discharge, said plurality of nozzles being disposed in the barrel at locations along the barrel toward the muzzle from said at least one nozzle;

(d) an opening disposed in said slide for maintaining said at lease one nozzle and said plurality of further nozzles exposed during translation of said slide from the battery position to the recoil position and return; and (e) a barrel bushing disposed intermediate said slide and the barrel for supporting said slide upon the barrel, said barrel bushing being configured to maintain said at least one nozzle and said plurality of further nozzles exposed during translation of said slide.

15. The apparatus as set forth in claim 14 wherein said plurality of further nozzles comprises at least three nozzles.

16. The apparatus as set forth in claim 15 wherein said at least one nozzle and said plurality of further nozzles are in line.

17. The apparatus as set forth in claim 14 wherein the bore includes an axis of rotation and wherein the thrust generated by said at least one nozzle and said plurality of further nozzles is in a common plane passing through the axis of rotation of the bore.

18. The apparatus as set forth in claim 14 wherein said plurality of nozzles are in line along said rib.

19. The apparatus as set forth in claim 14 wherein the bore of the barrel includes longitudinal axis of rotation and wherein the thrust generated by each of said nozzles is normal to the longitudinal axis of rotation of the bore and in a plane passing through the longitudinal axis of rotation of the bore.

20. The apparatus as set forth in claim 14 wherein each of said nozzles includes an inlet and an outlet and wherein said inlet is chamfered.

21. The apparatus as set forth in claim 14 wherein each nozzle defines a coefficient of thrust and wherein the coefficient of thrust of each nozzle of said at least one nozzle and said plurality of further nozzles is on the order of 1.5.

22. The apparatus as set forth in claim 14 wherein the barrel includes a front sight and wherein said slide includes a slit for receiving the front sight.

23. The apparatus as set forth in claim 22 wherein said barrel bushing includes a further slit and wherein said further slit is coincident with said slit of said slide.

24. The apparatus as set forth in claim 23 wherein said slit of said slide includes opposed sidewalls and wherein the further slit of said barrel bushing includes further opposed sidewalls in alignment with said opposed sidewalls of said slide slit.

25. The apparatus as set forth in claim 14 wherein said barrel bushing extends proximate the muzzle in the battery position of the firearm and wherein said barrel bushing extends part way about the barrel.

26. A method for reducing gun rise and muzzle jump of a semi automatic pistol having a linearly translatable slide translatable between a battery position and a recoil position and return during discharge upon discharge of the pistol to fire a projectile, which pistol includes a chamber, a barrel having a bore and a muzzle at the anterior end of the barrel, said method comprising the steps of:

(a) venting propellant gas during discharge of the firearm upwardly from the bore and through a port at a location along the barrel closer to the chamber than to the muzzle;

(b) discharging propellant gas during discharge of the firearm upwardly from the bore and through a plurality of ports at locations disposed toward the muzzle from the port closest to the chamber;

(c) expelling substantially all of the propellant gas through the ports prior to exit of the projectile from the muzzle; and (d) maintaining the ports exposed during translation of the slide.

27. The method as set forth in claim 26 wherein the bore includes an axis of rotation and wherein said steps of venting and discharging vent the propellant gas through the ports in a substantially common plane, which plane passes through the axis of rotation of the bore.

28. The method as set forth in claim 26 including the step of developing downwardly directed thrust upon exercise of said steps of venting and discharging.

29. The method as set forth in claim 28 wherein the pistol includes a center of mass and wherein the thrust developed upon exercise of said thrust developing step acts through a thrust vector and wherein the thrust vector occurs just anterior of the center of mass of the pistol.

30. The method as set forth in claim 28 including the step of providing more thrust at the nozzle most distant from the muzzle than at the nozzle closest to the muzzle.

31. The method as set forth in claim 28 wherein the pistol includes a center of mass and wherein the thrust developed upon exercise of said thrust generating step acts through a thrust vector and wherein the thrust vector occurs just anterior of the center of mass of the pistol.

32. The method as set forth in claim 26 wherein the barrel of the pistol includes a longitudinally extending rib and wherein the ports comprise nozzles extending from the bore through the barrel and through the rib and including the step of generating thrust upon passage of the propellant gas through the nozzles to urge downward movement of the pistol upon discharge.

33. The method as set forth in claim 32 including the step of providing more thrust at the nozzle most distant from the muzzle than at the nozzle closest to the muzzle.

34. The method as set forth in claim 32 wherein the pistol includes a center of mass and wherein the thrust developed upon exercise of said thrust generating step acts through a thrust vector and wherein the thrust vector occurs just anterior of the center of mass of the pistol.

35. The method as set forth in claim 32 wherein the bore includes an axis of rotation and wherein said steps of venting and discharging vent the propellant gas through the nozzles in a substantially common plane, which plane passes through the axis of the bore.

36. The method as set forth in claim 32 including the step of developing downwardly directed thrust upon exercise of said steps of venting and discharging.

37. The method as set forth in claim 36 wherein the pistol includes a center of mass and wherein the thrust developed upon exercise of said thrust developing step acts through a thrust vector and wherein the thrust vector occurs just anterior of the center of mass of the pistol.

* * * * *